US007503797B2

(12) United States Patent
Lappoehn

(10) Patent No.: US 7,503,797 B2
(45) Date of Patent: Mar. 17, 2009

(54) PLUG-IN CONNECTOR WITH STRAIN RELIEF

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/899,341

(22) Filed: Sep. 5, 2007

(65) Prior Publication Data

US 2008/0076295 A1 Mar. 27, 2008

(30) Foreign Application Priority Data

Sep. 26, 2006 (DE) ..... 10 2006 045 808

(51) Int. Cl.
*H01R 4/24* (2006.01)

(52) U.S. Cl. ..... 439/404; 439/409

(58) Field of Classification Search ..... 439/404, 439/417, 444, 460, 499, 387
See application file for complete search history.

(56) References Cited

U.S. PATENT DOCUMENTS

| | | | | |
|---|---|---|---|---|
| 4,068,912 A | | 1/1978 | Hudson, Jr. et al. | |
| 4,296,989 A | | 10/1981 | Larson et al. | |
| 4,496,206 A | * | 1/1985 | Markwardt et al. | 439/409 |
| 4,988,311 A | | 1/1991 | Tanzola | |
| 5,076,801 A | | 12/1991 | Schroll | |
| 5,186,651 A | | 2/1993 | Fuchs et al. | |
| 5,989,057 A | * | 11/1999 | Gerke et al. | 439/417 |
| 6,015,312 A | * | 1/2000 | Escane | 439/417 |
| 6,152,760 A | * | 11/2000 | Reeser | 439/409 |
| 6,398,581 B1 | * | 6/2002 | Baier et al. | 439/404 |
| 7,335,049 B2 | * | 2/2008 | Alarcon et al. | 439/409 |

FOREIGN PATENT DOCUMENTS

| | | |
|---|---|---|
| DE | 27 36 244 A1 | 2/1978 |
| DE | 34 33 000 A1 | 5/1985 |
| DE | 35 43 257 C2 | 6/1987 |
| DE | 41 02 541 C1 | 3/1992 |
| DE | G 91 16 689 U1 | 8/1993 |
| DE | 43 17 725 A1 | 12/1993 |
| DE | 94 02 621 U1 | 5/1994 |
| DE | 296 17 190 U1 | 3/1997 |
| DE | 197 33 202 C1 | 4/1999 |
| DE | 198 38 423 A1 | 3/2000 |
| DE | 101 62 845 C1 | 6/2003 |
| EP | 0 135 122 A2 | 3/1985 |
| EP | 0 645 851 A1 | 3/1995 |

OTHER PUBLICATIONS

German Office Action dated Apr. 25, 2007 (with translation of relevant portions).
Response to German Office Action dated Aug. 14, 2007 (with translation of relevant portions).

* cited by examiner

*Primary Examiner*—Michael C Zarroli
(74) *Attorney, Agent, or Firm*—Collard & Roe, P.C.

(57) ABSTRACT

A plug-in connector has a base element containing at least one insulation displacement contact which bonds and locates an at least single-core insulated cable in the assembled condition of the plug-in connector. The base element includes at least one inelastic clamping element the length of which is selected so that in the assembled condition of the plug-in connector the clamping element deforms a cable insulation or penetrates the cable insulation at least in part thereby clamping the cable.

11 Claims, 7 Drawing Sheets

PLUG-IN CONNECTOR WITH STRAIN RELIEF

CROSS REFERENCE TO RELATED APPLICATIONS

Applicant claims priority under 35 U.S.C. §119 of German Application No. 10 2006 045 808.7 filed Sep. 26, 2006.

PRIOR ART

The present invention relates to a plug-in connector with strain relief according to the preamble of the independent claim.

Ribbon cable plug-in connectors for connecting drive controllers with the corresponding drives, which have a predefined number of contacts for bonding a corresponding number of lines of the ribbon cable, have been known in computer engineering. All lines are located and bonded separately inside the plug-in connector, for example using insulation displacement contacts.

Patent Application EP 135 122 A2 discloses a plug-in connector for a ribbon cable where the upper and the lower parts of a screening of the ribbon cable are connected with a screening of the plug housing via mounting elements. The screening of the ribbon cable is stripped from the upper and the lower surfaces and is bent to the rear so that the screening comes to rest on the outer insulation of the ribbon cable. Bonding between the mounting elements and the screening is effected by a screwed joint. Strain relief for the ribbon cable is achieved mainly by fixing the screening of the ribbon cable in its position.

Patent Specification DE 34 33 000 C2 describes a multipole plug-in connector for a ribbon cable where the conductors of the ribbon cable are located and bonded by means of insulation displacement contacts, while a screening of the ribbon cable is bonded and located using a metal clip. Strain relief is realized by a U-shaped guide for the ribbon cable in the plug housing and by the clamping pressure exerted by the metal clip.

A plug-in connector comprising a housing for receiving a printed circuit board with an insulation displacement contact for electric connection of an insulated conductor has been known from Patent Specification DE 197 33 202 C1. The plug housing comprises a cover with a plurality of integrally formed supporting ribs. As the cover is closed the supporting ribs simultaneously urge the conductor into the blades of the insulation displacement contact by the same operation.

Patent Specification DE 41 02 541 C1 describes a multipole plug-in connector for bonding of a ribbon cable. The ribbon cable comprises a plurality of insulated conductors that are spaced one from the other by comparatively broad webs. Some of the webs comprise recesses which are engaged by detents in the assembled condition of the plug-in connector whereby strain relief is achieved.

Utility Patent G 91 16 689 describes a line holder with strain relief for insulated electric circular lines where high pull-out forces are achieved by transverse shear bars arranged on an upper part of the line holder, which bars are inserted, in the mounted condition of the line holder, between the insulation displacement contacts arranged in the lower part of the line holder thereby urging the limbs of neighboring insulation displacement contacts into contact with the conductors of neighboring circular lines.

Utility Patent DE 296 17 190 U1 describes a device for electrically connecting insulated lines having at least two cores, where the connection of each conductor is realized via insulation displacement contacts. In the lower part of the line terminal, separating webs are provided beside the insulation displacement contacts that are equipped with cutting edges on their upper end. The separating webs separate the two-core cable to form two separate lines during the mounting operation, before bonding is effected by the insulation displacement contacts.

Patent Specification DE 101 62 845 C1 discloses a plug-in connector for a ribbon cable with strain relief which comprises an elastic pressure member arranged in the lower part of the plug-in connector where the insulation displacement contacts are arranged, which elastic pressure member is bent by the upper part of the plug-in connector in the direction of the insulation of the ribbon cable during assembly. The compression member penetrates the insulation at least in part thereby providing strain relief.

Now, it is the object of the present invention to provide a plug-in connector, especially for a ribbon cable, which comprises strain relief means that provide high pull-out force and that can be realized by simple means.

That object is achieved by the features defined in the independent claim.

DISCLOSURE OF THE INVENTION

The plug-in connector according to the invention comprises a base element containing at least one insulation displacement contact which bonds and locates an at least single-core insulated cable in the assembled condition of the plug-in connector. The base element comprises at least one inelastic clamping element the length of which is selected so that in the assembled condition of the plug-in connector the clamping element deforms the cable insulation or penetrates the cable insulation at least in part.

The plug-in connector according to the invention comprises a strain relief system that provides high pull-out force. This considerably increases the security of the cable from being torn off the plug-in connector in the completely assembled condition.

The at least one clamping element provided according to the invention may in principle be made from metal. Given the fact that in certain cases the clamping element may penetrate the cable insulation up to the conductor or even past the conductor, the clamping element preferably is made from an electrically non-conductive plastic material. The clamping element can then be produced together with the base element, for example by plastic injection molding, without any particular additional expense. This permits the entire plug-in connector according to the invention to be produced substantially without any additional cost, which results in cost advantages especially in series production.

Another considerable advantage resides in the fact that strain relief can be realized substantially without any additional space being required. As a result, the form of the plug-in connector can be kept small. This is a particular advantage especially in cases where the cable intended to be used is a multi-core cable, for example a ribbon cable.

A further, especially substantial advantage of the plug-in connector according to the invention results from a simple mounting procedure without any additional step, compared with the previous mounting procedure of comparable known plug-in connectors. This provides further cost advantages, especially in series production of the completely assembled plug-in connector.

Advantageous further developments and embodiments of the invention can be derived from dependent claims.

One embodiment provides that the clamping element is arranged immediately adjacent an insulation displacement contact. The term immediately adjacent is meant to say that the holding force exerted by the insulation displacement contact can be utilized almost fully for pressing the cable insulation onto the insulation displacement contact.

Preferably, at least one clamping element is provided before and behind the insulation displacement contact, related to the longitudinal direction of the cable.

One advantageous embodiment provides that the clamping element clamps the cable insulation relative to the base element at least approximately in the area of the diameter of the core, related to the mounting direction of the cable. The clamping element is thereby given a larger surface of action. Especially, the cable insulation is prevented from giving way laterally.

According to another embodiment, the clamping element is provided with a pointed tip. The pointed tip provides an especially high clamping force that results in a correspondingly high pull-out force. In certain cases the pointed tip may dig into the cable insulation and get stuck in the cable insulation. Preferably, the pointed tip is oriented in the longitudinal direction of the cable. A further development of that embodiment provides that a clamping element comprises a plurality of pointed tips that either deform the cable insulation at different points or are capable of digging themselves into the cable insulation at least in part.

One embodiment comprises at least one clamping element that clamps a connection web of a cable, extending between two neighboring cores, in the mounted condition of the plug-in connector. According to a further development of that embodiment a clamping element comprises a pointed tip that clamps the connecting web, and further the width of that clamping element is selected to ensure that at least one, preferably both neighboring cores are clamped.

The plug-in connector according to the invention preferably, comprises an upper part that presses the cable onto the base element in the mounted condition of the plug-in connector. Preferably, the upper part contains a cable duct intended to receive the cable prior to assembly of the plug-in connector.

One embodiment provides that the upper part comprises at least one guide channel into which the at least one clamping element is inserted during assembly of the plug-in connector. At least one area adjacent the guide channel is preferably configured as an abutment that is arranged approximately opposite the clamping element in the assembled condition of the plug-in connector. This has the effect to increase the compression force exerted by the at least one clamping element on the cable insulation.

According to a different embodiment, the upper part comprises at least one positioning element that positions the upper part relative to the base element during assembly of the plug-in connector.

Further, the upper part preferably comprises at least two detents that lock the upper part on the base element at the end of the assembly process.

Other advantageous further developments and configurations of the plug-in connector with strain relief according to the invention are apparent from further dependent claims. Certain embodiments of the plug-in connector according to the invention will be described hereafter and are illustrated in the drawing in which:

DESCRIPTION OF THE EMBODIMENTS

Figure 1:
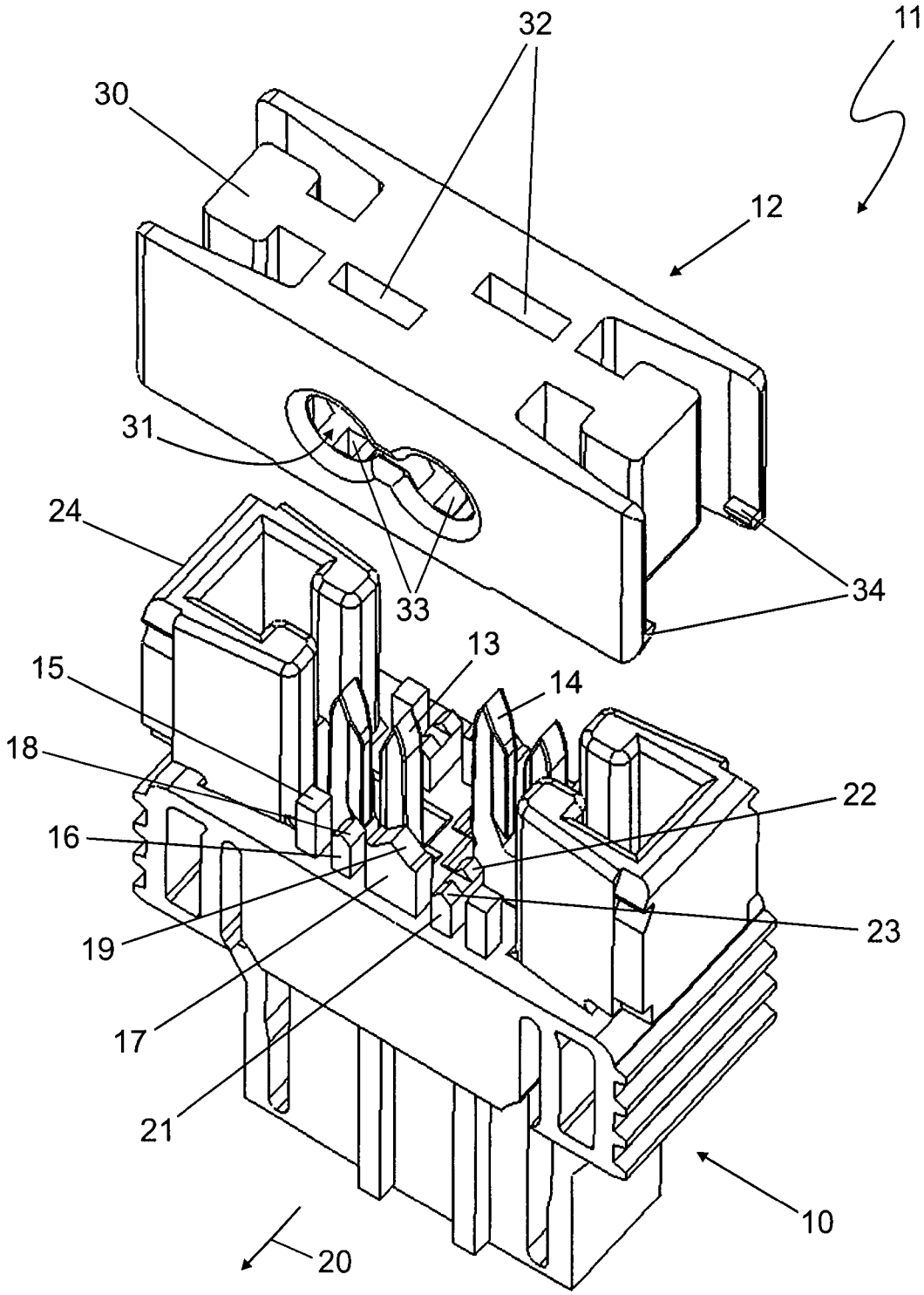
FIG. 1 shows a perspective view especially of a base element of a plug-in connector according to the invention prior to assembly of the plug-in connector.

FIG. 1 shows a perspective view especially of a base element 10 of a plug-in connector 11 according to the invention prior to assembly of the cable which will be illustrated in FIGS. 4 to 7. The plug-in connector 11 further preferably comprises an upper part 12.

The base element 10 contains at least one insulation displacement contact 13, 14. A first, a second and a first clamping element 15, 16, 17 are arranged before and/or beside and/or behind the insulation displacement contact 13. The first and the third clamping elements 15, 17 are arranged laterally, related to the center of a core of the cable illustrated in FIGS. 4 to 7, while the second clamping element 16 is arranged at least approximately before and/or behind the clamping opening of the clamping element 13.

The first clamping element 15 has a flat upper end. The second and the third clamping elements 16, 17 are each provided with a pointed tip 18, 19. The pointed tips 18, 19 are preferably arranged to extend in the longitudinal direction 20 of the cable illustrated in FIGS. 4 to 7.

Neighboring the insulation displacement contact 14, especially before and/or behind the insulation displacement contact 14, there is provided a forth clamping element 21 which, compared with the first to third clamping elements 15, 16, 17 has a greater length extending in the longitudinal direction 20 and which distinguishes itself from the first to third clamping elements 15 to 17 in that it has two separate pointed tips 22, 23.

The base element 10 preferably comprises at least one positioning element guide 24, intended to guide an upper part 12 provided in certain cases, which preferably contains at least one positioning element 30 corresponding to the positioning element guide 24.

The upper part 12 preferably contains at least one cable duct 31 intended to receive the cable that is shown in more detail in FIGS. 4 to 7.

The upper part 12 preferably comprises at least one recess 32 into which the at least one insulation displacement contact 13, 14 is inserted during assembly of the plug-in connector 11. Further, the upper part 12 preferably comprises at least one guide channel 33 into which the at least one clamping element 15, 16, 17, 21 is inserted during assembly of the plug-in connector 11.

In addition, the upper part 12 preferably comprises two detents 34 for locking the upper part 12 on the base element 10 in the assembled condition of the plug-in connector 11.

Two detents 34, provided on one end of the upper part 12 one opposite the other, can be seen for example in FIG. 1. Corresponding detents 34 are preferably provided on the other end of the upper part 12 although they are not visible in FIG. 1.

As has been mentioned before, the upper part 12 is not absolutely necessary. In principle, the cable illustrated in more detail in FIGS. 4 to 7 might be bonded and located in the base element 10 even without an upper part 12. The clamping force exerted by the at least one insulation displacement contact 13, 14 may already be sufficient to press a cable insulation onto the at least one clamping element 15, 16, 17, 21. In that case, a high pull-out force is achieved especially when the at least one clamping element 15, 16, 17, 21 is arranged immediately adjacent the insulation displacement contact 13, 14.

However, the upper part 12 preferably is provided for bonding and locating the cable by the at least one insulation displacement contact 13, 14 during assembly of the plug-in connector 11. Further, the upper part 12 preferably is configured to additionally exert a clamping force on the cable insulation for pressing the cable insulation onto the at least one clamping element 15, 16, 17, 21.

Advantageously, the upper part 12 is provided with the at least one cable duct 31 for receiving the cable prior to the assembly process. As a result of that measure high positioning accuracy relative to the insulation displacement contact 13, 14 is achieved for the cable. Also, assembly of the plug-in connector 14 is considerably facilitated.

Figure 2:
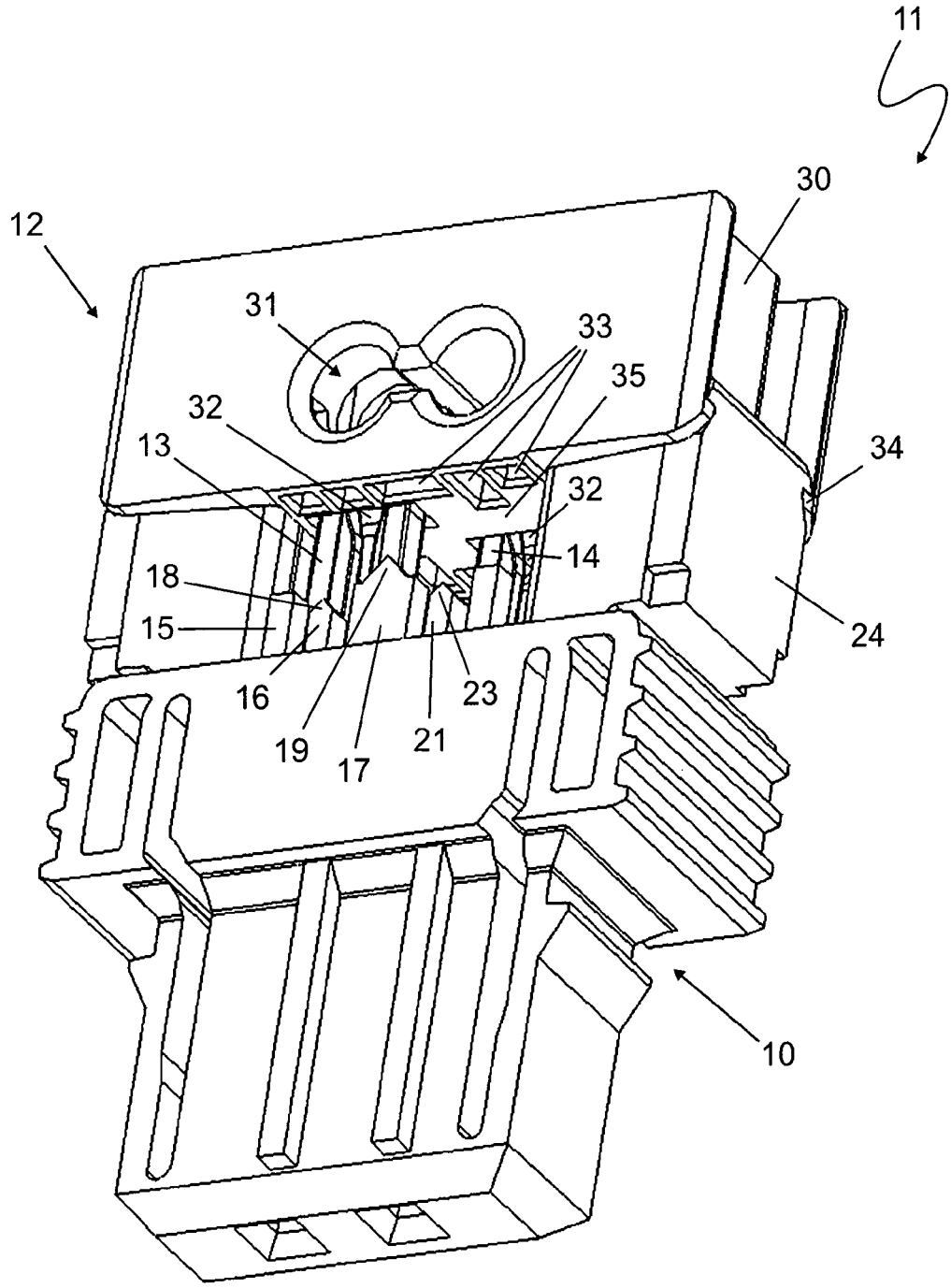
FIG. 2 shows a perspective view especially of an upper part of a plug-in connector according to the invention during assembly of the plug-in connector.

FIG. 2 shows a perspective view especially of the upper part 12 during assembly of the plug-in connector 11. Parts identical to those shown in FIG. 1 are designated in this Figure by the same reference numerals.

The illustration of FIG. 2 shows the position of the upper part 12, relative to the base element 10, where the at least one insulation displacement contact 13, 14 is inserted into the recess 32. The at least one clamping element 15, 16, 17, 21 has not yet been inserted into the corresponding guide channel 33 in that position, while the positioning element 30 is just beginning to enter the positioning element guide 24 of the base element 10.

FIG. 2 provides a view of those areas of the upper part 12 that surround the at least one guide channel 33. At least part of that area is configured as an abutment 35 which in the assembled condition of the plug-in connector 11 is positioned at least approximately opposite a corresponding clamping element 15, 16, 17, 21 thereby providing an additional counterforce suited to locate the cable insulation on the clamping element 15, 16, 17, 21.

Figure 3:
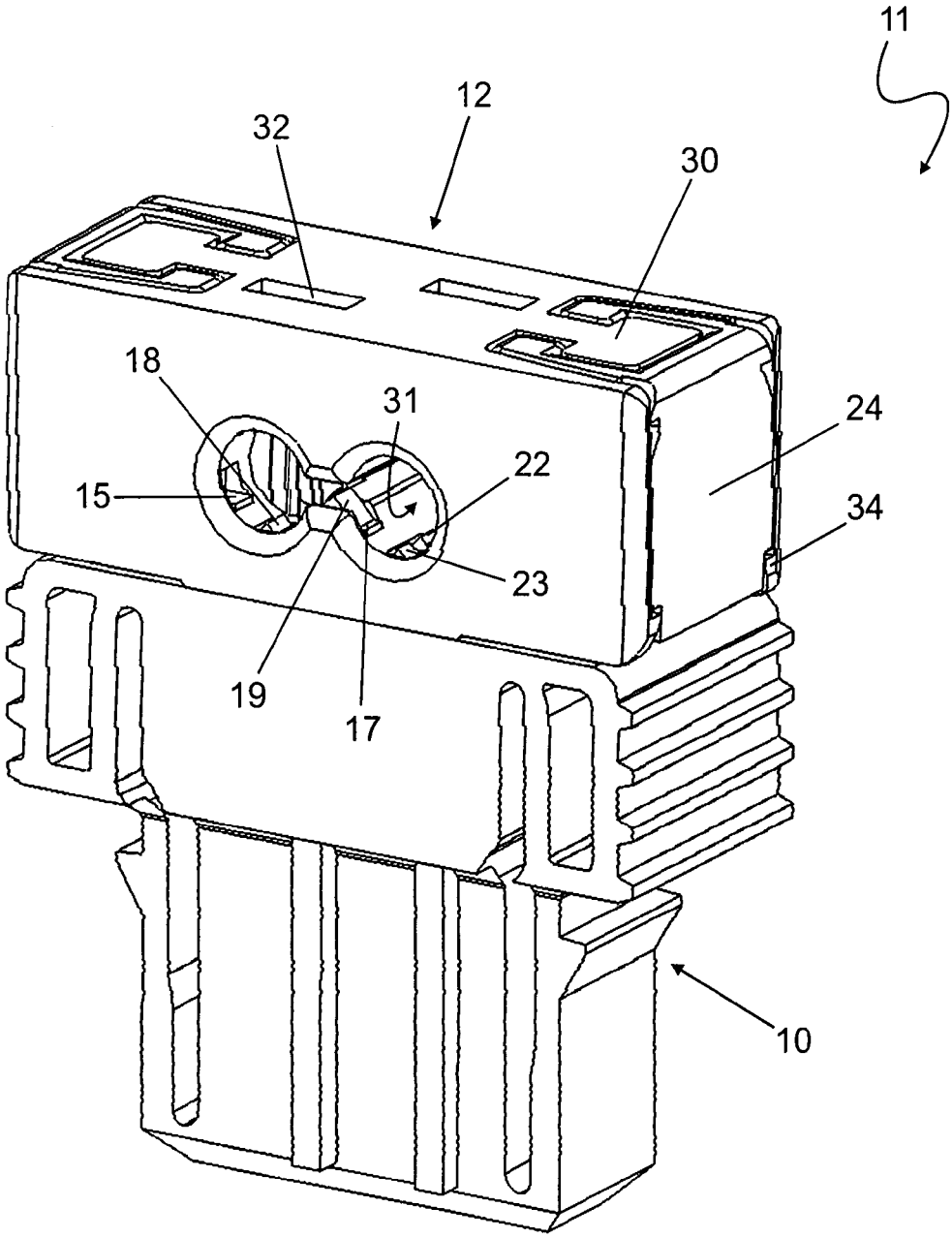
FIG. 3 shows a perspective view of a plug-in connector according to the invention in the assembled condition of the plug-in connector, with no cable fitted.

FIG. 3 shows a perspective view of the plug-in connector 11 in the assembled condition, without a cable fitted, in order to provide a view of the position of the at least one clamping element 15, 16, 17, 21 in the assembled condition of the plug-in connector 11. Parts identical to those shown in FIGS. 1 and 2 are again indicated by the same reference numerals.

In the position illustrated in FIG. 3 the first clamping element 15, the pointed tips 18 of the second clamping element 16, the third clamping element 17 as well as the latter's pointed tips 19 and the two pointed tips 22, 23 of the third clamping element 21 can be seen projecting into the cable duct 31 at least in part.

Figure 4:
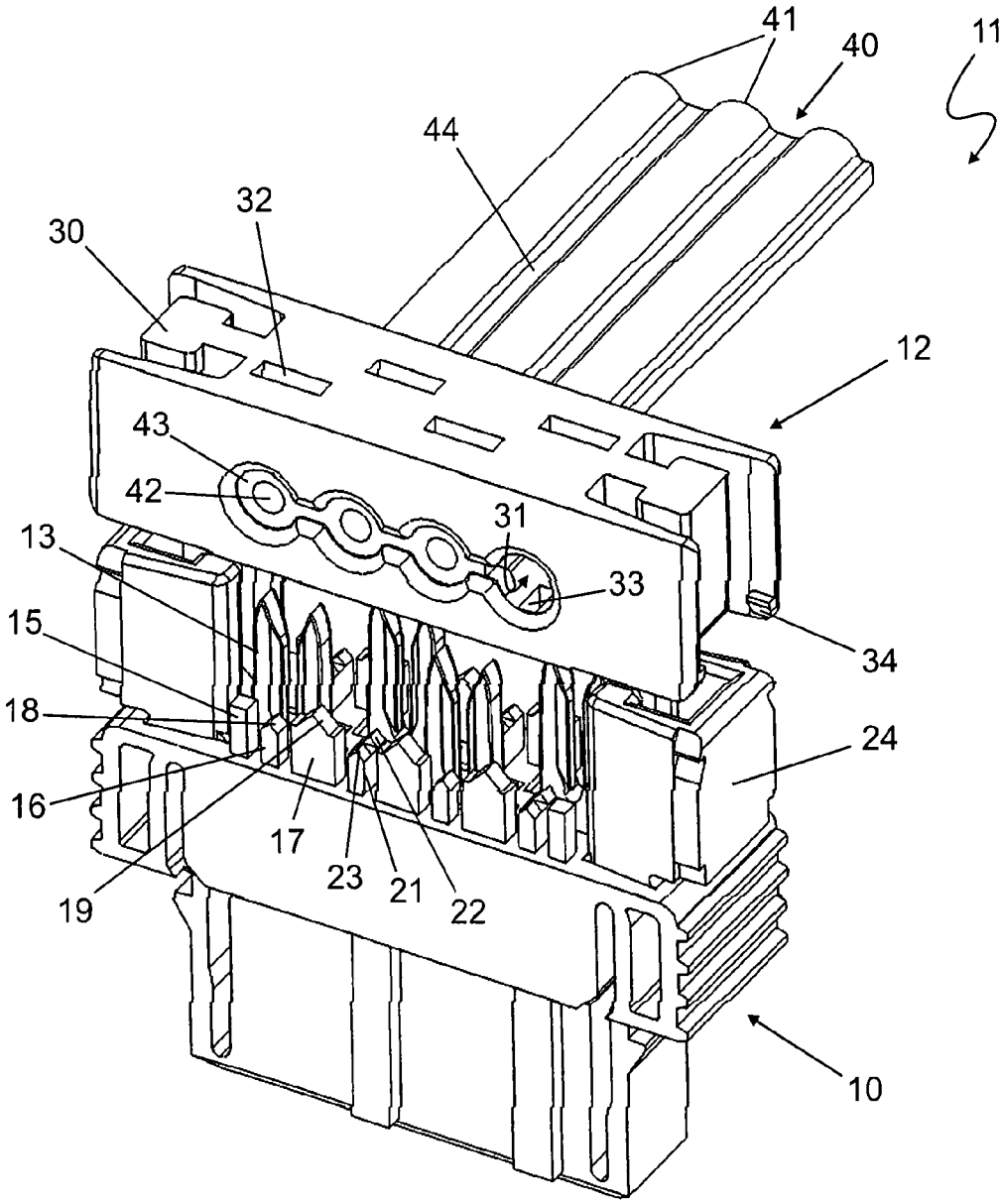
FIG. 4 shows a perspective view especially of a base element of a plug-in connector according to the invention with a cable fitted in a cable duct, prior to assembly of the plug-in connector.

FIG. 4 shows a perspective view of the base element 10 and the upper part 12 with a cable 40 fitted in the upper part 12. Parts illustrated in FIG. 4 that are identical to the parts illustrated in the preceding Figures, are indicated by the same reference numerals.

It is assumed in the illustrated embodiment that the cable 40 consists of a ribbon cable having four cores 41, three cores 41 being illustrated in FIG. 4, while the forth core 41 has been omitted to provide a view of a guide channel 33 inside the upper part 12.

Further, it is assumed in the illustrated embodiment that the upper part 12 comprises at least one cable duct 31—four cable ducts 31 being shown in the Figure—for positioning and locating the cable 40 prior to assembly of the plug-in connector 11.

The cable 40 comprises at least one conductor 42 which is enclosed by a cable insulation 43. Further, it is assumed by way of example that the different cores 41 of the cable 40 are connected one to the other via connection webs 44.

Figure 5:
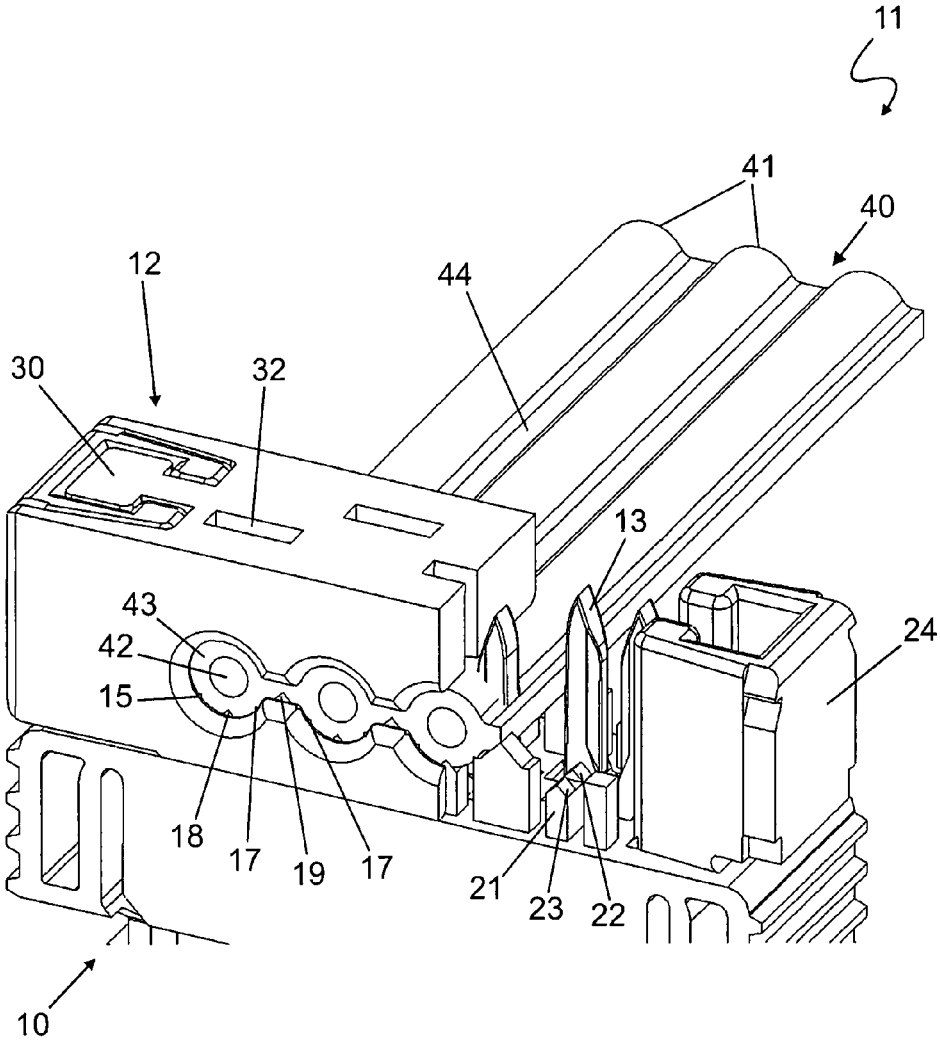
FIG. 5 shows a perspective view, sectioned in part, of a plug-in connector according to the invention in the assembled condition of the plug-in connector.

FIG. 5 shows a perspective view, sectioned in part, of the plug-in connector 11 in the assembled condition. Those parts illustrated in FIG. 5 that are identical to the parts illustrated in the preceding Figures are indicated by the same reference numerals.

In FIG. 5 it can be seen how an insulation displacement contact 13 pierces the cable insulation 43 of a cable 41 during assembly of the plug-in connector 11, establishes contact with the conductor 42 and fixes the conductor 42 in its position. During assembly, the positioning element 30 of the upper part 12 has entered the positioning element guide 24 of the base element 10. The detents 34, which are not visible in FIG. 5, have snapped into their final positions so as to lock the upper part 12 on the base element 10.

As can be seen in FIG. 5, the at least one clamping element 15, 16, 17, 21 clamps the cable insulation 43 either by deformation or even by penetrating into the cable insulation 43 at least in part, thereby considerably increasing the pull-out force of the cable 40 relative to the plug-in connector 11. The length of the at least one clamping element 15, 16, 17, 21 should be selected accordingly.

The length determines whether the at least one clamping element 15, 16, 17, 21 will only deform the cable insulation 43 or will penetrate into the cable insulation 43 at least in part and get firmly stuck in the cable insulation 43. As the at least one clamping element 15, 16, 17, 21 is to be realized as an inelastic element, the clamping element 15, 16, 17, 21 will provide the necessary rigidity and, thus, the required force.

The clamping element 15, 16, 17, 21, which preferably is electrically non-conductive, could even penetrate into the cable insulation 43 up to the conductor 42 or could pierce the cable insulation 43 outside the conductor 42 completely or almost completely.

In the illustrated embodiment it is assumed that the first clamping element 15 clamps the cable insulation 43 relative to the base element 10 at a position outside the diameter of the core 41, related to the mounting direction of the upper part 12. The pointed tip 18 of the second clamping element 16 clamps the cable insulation 43 at least approximately on a diameter of a core 41 relative to the before-mentioned mounting direction.

In the embodiment illustrated in FIG. 5 it is assumed that the third clamping element 17 is present and clamps the connection web 44 between the two cores 41 of the cable 40 by its at least one pointed tip 19. Further, it is provided according to that embodiment that the width of the second clamping element 17 is selected to ensure that the third clamping element 17 will further clamp at least one cable insulation 43, preferably both neighboring cable insulations 43, outside the diameter of the core 41, related to the before-mentioned mounting direction.

Figure 6:
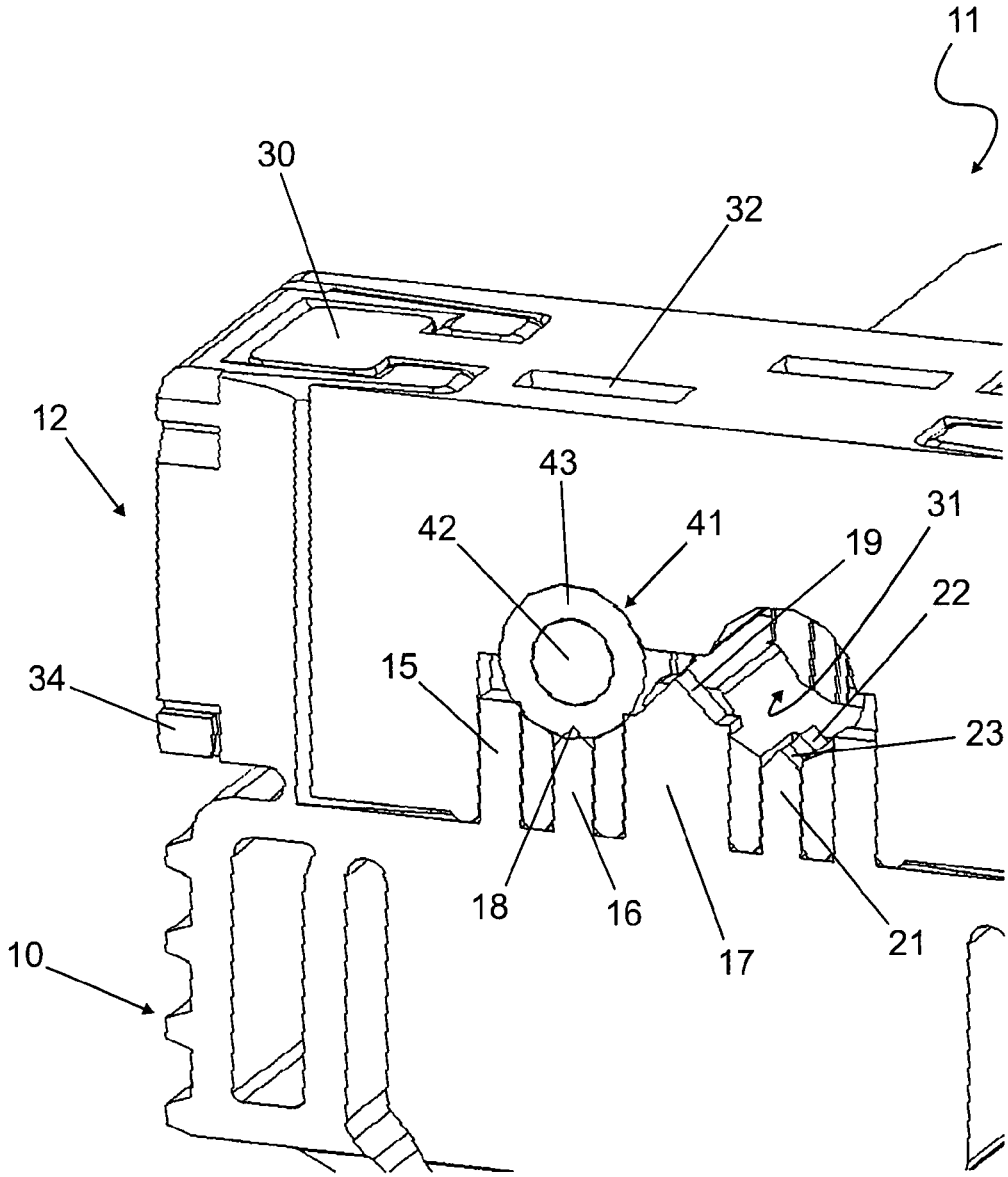
FIG. 6 shows a perspective view of a cross-section through a front of a plug-in connector according to the invention, in the assembled condition of the plug-in connector.

FIG. 6 shows a perspective sectional view through the front of the plug-in connector 11 in the assembled condition, it being assumed in this case that the upper part 12 comprises at least one cable duct 31. Those parts illustrated in FIG. 6 that are identical to the part illustrated in the preceding Figures, are indicated by the same reference numerals.

The illustration shows a line 41 in place. The section taken through the front of both the upper part 12 and the base element 10 gives a full view of the arrangement of the at least one clamping element 15, 16, 17, 21 in FIG. 6.

A line duct 31 in the upper part 12 is shown without a cable in place so that the forth clamping element 21, comprising two separate pointed tips 22, 23 in the illustrated example, can be seen in the assembled condition of the plug-in connector 11.

Figure 7:
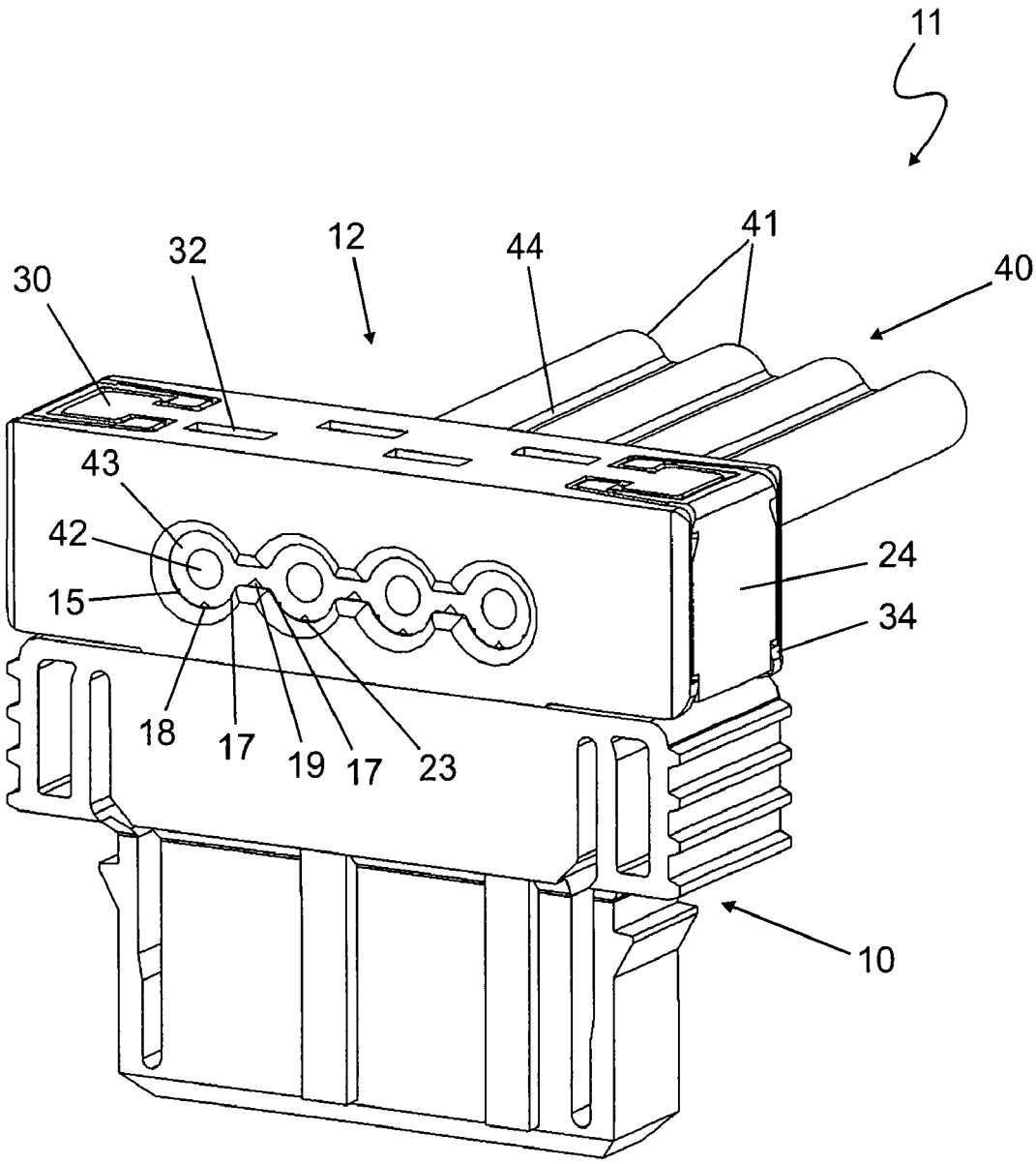
FIG. 7 shows a perspective view of a plug-in connector according to the invention in the assembled condition of the plug-in connector, with a cable in place.

Finally, FIG. 7 shows a perspective view of the plug-in connector 11 according to the invention in the assembled condition and with a cable 40 in place.

The invention claimed is:

1. Plug-in connector having a base element (10) containing at least one insulation displacement contact (13, 14) which bonds and locates an at least single-core insulated cable (40) in the assembled condition of the plug-in connector (11), wherein the base element (10) comprises at least one inelastic clamping element (15, 16, 17, 21) the length of which is selected so that in the assembled condition of the plug-in connector (11) the clamping element (15, 16, 17, 21) deforms the cable insulation (43) of the cable (40) or penetrates the cable insulation (43) at least in part thereby clamping the cable (40), wherein at least one clamping element (17) is provided that clamps a connection web (44) of the cable (40), extending between two neighboring cores (41), in the mounted condition of the plug-in connector (11), wherein the clamping element (17) comprises a pointed tip (19) that clamps the connecting web (44) in the assembled condition of the plug-in connector (11), wherein the width of that clamping element (17) is selected to ensure that at least one core (41) of two neighboring cores (41) of the cable (40) is additionally clamped by the clamping element (17), wherein the plug-in connector (11) comprises an upper part (12) that presses the cable (40) onto the base element (10) in the mounted condition of the plug-in connector (11), and wherein the upper part (12) comprises at least one guide channel (33) into which the at least one clamping element (15, 16, 17, 21) is inserted during assembly of the plug-in connector (11).

2. The plug-in connector as defined in claim 1, wherein the clamping element (15, 16, 17, 21) is arranged immediately adjacent an insulation displacement contact (13, 14).

3. The plug-in connector as defined in claim 1, wherein at least one clamping element (15, 16, 17, 21) is provided before and behind the insulation displacement contact (13, 14), related to the longitudinal direction (20) of the cable (40).

4. The plug-in connector as defined in claim 1, wherein at least one clamping element (15, 16, 17, 21) is made from an electrically non-conductive plastic material.

5. The plug-in connector as defined in claim 1, wherein the clamping element (15, 16, 17, 21) clamps the cable insulation (43) relative to the insulation displacement contact (13, 14) at least approximately in the area of the diameter of the core (41), related to the mounting direction of the cable.

6. The plug-in connector as defined in claim 1, wherein the pointed tip (18, 19, 22, 23) is oriented in the longitudinal direction (20) of the cable (40).

7. The plug-in connector as defined in claim 1, wherein the clamping element (1,5 16, 17, 21) comprises a plurality of pointed tips (22, 23).

8. The plug-in connector as defined in claim 1, wherein the upper part (12) contains at least one cable duct (31) intended to receive the cable (40).

9. The plug-in connector as defined in claim 1, wherein the upper part (12) comprises an abutment (35) arranged approximately opposite the clamping element (15, 16, 17, 21) in the assembled condition of the plug-in connector (11).

10. The plug-in connector as defined in claim 1, wherein the upper part (12) comprises at least one positioning element (30) that positions the upper part (12) relative to the base element (10) during assembly of the plug-in connector (11).

11. The plug-in connector as defined in claim 1, wherein the upper part (12) comprises at least two detents (34) that lock the upper part (12) on the base element (10) at the end of the assembly process.

* * * * *